US006906738B2

(12) United States Patent
Turner et al.

(10) Patent No.: US 6,906,738 B2
(45) Date of Patent: Jun. 14, 2005

(54) MULTISPEED LASER PRINTING USING A SINGLE FREQUENCY SCANNING MIRROR

(75) Inventors: Arthur Monroe Turner, Allen, TX (US); Andrew Steven Dewa, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/611,562

(22) Filed: Jun. 30, 2003

(65) Prior Publication Data

US 2004/0263608 A1 Dec. 30, 2004

(51) Int. Cl.[7] ..... B41J 2/47
(52) U.S. Cl. ..... 347/229

(58) Field of Search ..... 347/229, 248, 347/243, 244, 258; 359/223, 224

(56) References Cited

U.S. PATENT DOCUMENTS 6,295,154 B1 9/2001 Laor et al.

*Primary Examiner*—Huan Tran
(74) *Attorney, Agent, or Firm*—William B. Kempler; W. James Brady, III; Frederick J. Telecky, Jr.

(57) ABSTRACT

A laser printer using a single frequency resonant mirror for providing the beam sweep for printing at a multiplicity of printing speeds. According to a first embodiment, a pair of torsional hinges 54*a* and 54*b* provides the resonant beam sweep. The number of line images per unit of measurement is changed as a function of printer speeds to achieve the desired image proportions.

19 Claims, 10 Drawing Sheets

MULTISPEED LASER PRINTING USING A SINGLE FREQUENCY SCANNING MIRROR

TECHNICAL FIELD

The present invention relates generally to "laser printers" and more specifically to the use of MEMS (micro-electric mechanical systems) type mirrors (such as torsional hinge mirrors) to provide raster type scanning across a moving photosensitive medium, such as a drum. The torsional hinges are used for providing the raster scan at a controlled resonant frequency about an axis of oscillation at a multiplicity of printer speeds.

BACKGROUND

Rotating polygon scanning mirrors are typically used in laser printers to provide a "raster" scan of the image of a laser light source across a moving photosensitive medium, such as a rotating drum. Such a system requires that the rotation of the photosensitive drum and the rotating polygon mirror be synchronized so that the beam of light (laser beam) sweeps or scans across the rotating drum in one direction as a facet of the polygon mirror rotates past the laser beam. The next facet of the rotating polygon mirror generates a similar scan or sweep which also traverses the rotating photosensitive drum but provides an image line that is spaced or displaced from the previous image line.

The rotational speed of a typical polygon mirror can be varied over a small range, but significantly higher rotational speeds requires more advanced and robust bearing technology which, of course, means significantly higher manufacturing costs. Because the cost of a polygon mirror increases significantly as the printer speed increases, it is not economical to use mirrors suitable for high speed printing with slower fixed speed printers. Also, multi-speed printers that provide both high speed and slow speed printing typically require a different polygon mirror for each of the different speeds. Consequently, printer manufacturers typically must maintain a large inventory of different polygon mirrors to cover the range of printer speeds offered for sale.

There have also been prior art efforts to use a less expensive flat mirror with a single reflective surface, such as a resonant mirror, to provide a scanning beam. For example, a single axis scanning mirror may be used to generate the beam sweep or scan instead of a rotating polygon mirror. The rotating photosensitive drum and the scanning mirror are synchronized as the "resonant" mirror first pivots or rotates in one direction to produce a printed image line on the medium that is at right angles or orthogonal with the movement of the photosensitive medium. However, the return sweep will traverse a trajectory on the moving photosensitive drum that is at an angle with the printed image line resulting from the previous sweep. Consequently, use of a single reflecting surface resonant mirror according to the prior art required that the modulation of the reflected light beam be interrupted as the mirror completed the return sweep or cycle, and then again start scanning in the original direction. Using only one of the sweep directions of the mirror, of course, reduces the print speed and requires expensive and sophisticated synchronization of stops and starts of the rotating drum. Therefore, to effectively use an inexpensive resonant mirror requires that the mirror surface be continuously and easily adjusted in a direction perpendicular to the scan such that the resonant sweep of the mirror in each direction generates images on a moving or rotating photosensitive drum that are always parallel. This continuous perpendicular movement may be accomplished by the use of a dual axis torsional mirror, or a pair of single axis mirrors. Of course, either of these solutions is more expensive than using one single frequency scanning mirror.

Texas Instruments presently manufactures torsional axis analog mirror MEMS devices fabricated out of a single piece of material (such as silicon, for example) typically having a thickness of about 100–115 microns. A dual axis version layout consists of a mirror supported on a gimbal frame by two silicon torsional hinges. The mirror may be of any desired shape, although an oval shape is typically preferred. An elongated oval shaped mirror having a long axis of about 4.0 millimeters and a short axis of about 1.5 millimeters has been found to be especially suitable. The gimbal frame is attached to a support frame by another set of torsional hinges. This dual axis Texas Instruments' manufactured mirror has been found to be particularly suitable for use with a laser printer. A similar Texas Instruments' single axis mirror device is also fabricated by simply eliminating the gimbal frame and hinging the mirror directly to the support structure. One example of a dual axis torsional hinged mirror is disclosed in U.S. Pat. No. 6,295,154 entitled "Optical Switching Apparatus" and was assigned to the same assignee on the present invention.

Although MEMS type torsional hinged scanning mirrors are less expensive than polygon mirrors, they are designed to have a single resonant frequency within a rather narrow frequency band. Consequently, an inventory of different mirrors for different print speeds is still considered necessary.

Therefore, it will be appreciated that if a single resonant frequency scanning mirror could be used for both multi-speed printers and a series of printers having different fixed print speeds, manufacturing costs and inventory costs could be significantly reduced.

SUMMARY OF THE INVENTION

The problems mentioned above are addressed by the present invention which, according to one embodiment, provides a method of using the same basic single frequency scanning mirror apparatus as the drive engine for generating a sweeping or scanning beam of light across a photosensitive medium, such as for example a rotating drum, in both multi-speed laser printers or for various models of single speed printers, even though they may print at substantially different speeds.

More specifically, the method of this invention comprises the steps of providing a moving photosensitive medium that is sensitive to a selected light beam. The light beam is intercepted at the reflective surface of a single-frequency scanning mirror and redirected toward a photosensitive medium that is moving at a selected speed. The scanning mirror oscillates at the single frequency to sweep the redirected light beam back and forth across the moving photosensitive medium, and digital signals are generated for modulating the light beam so as to produce a multiplicity of image lines that are combined to create a selective image. Each of the multiplicity of image lines represents a selected number of addressable pixels per a selected unit of measurement, and the number of image lines generated per selected unit of measurement is adjusted as a function of the selected speed of the photosensitive medium so as to produce an image with selected proportions.

The resonant frequency mirror apparatus comprises a single reflective surface portion positioned to intercept the beam of light or laser beam from a light source. According to one embodiment, the reflective surface of the mirror device is supported by a single hinge arrangement, such as torsional hinges, for pivotally oscillating around an axis, and, according to another embodiment, the mirror may be further supported by a second hinge arrangement for pivoting about another axis substantially orthogonal to the first axis. Thus, pivotal oscillation of the mirror device about an axis results in a beam of light reflected from the mirror surface moving or sweeping across the photosensitive medium, and pivoting of the device about the second axis results in the sweeping light beam moving in a direction that is substantially orthogonal to the sweeping movement of the light beam. The mirror apparatus also includes driver circuitry for causing the pivoting oscillations or sweeping motion or scanning across the moving photosensitive medium. The moving photosensitive medium, such as a rotating drum, is located to receive the reflected modulated light beam as it sweeps a trace across the drum or moving medium between a first edge and a second edge. The photosensitive medium rotates or moves in a direction such that sequential image lines or traces are properly spaced from each other to provide the desired proportions or vertical dimensions of the image. If the reflecting mirror also moves orthogonal to the scanning motion to maintain the image lines parallel to each other, there is also included a second drive for pivoting about a second axis.

BRIEF DESCRIPTION OF THE DRAWINGS

Other objects and advantages of the invention will become apparent upon reading the following detailed description and upon referencing the accompanying drawings in which.

DETAILED DESCRIPTION OF ILLUSTRATIVE EMBODIMENTS

Like reference numbers in the figures are used herein to designate like elements throughout the various views of the present invention. The figures are not intended to be drawn to scale and in some instances, for illustrative purposes, the drawings may intentionally not be to scale. One of ordinary skill in the art will appreciate the many possible applications and variations of the present invention based on the following examples of possible embodiments of the present invention. The present invention relates to laser printers and primarily to the use of a basic single frequency scanning mirror apparatus with a moveable reflecting surface that is suitable for use to provide the raster scans for both a multi-speed laser beam type printer, or for various models of single speed printers where the various models operate at substantially different print speeds.

Figure 1A:
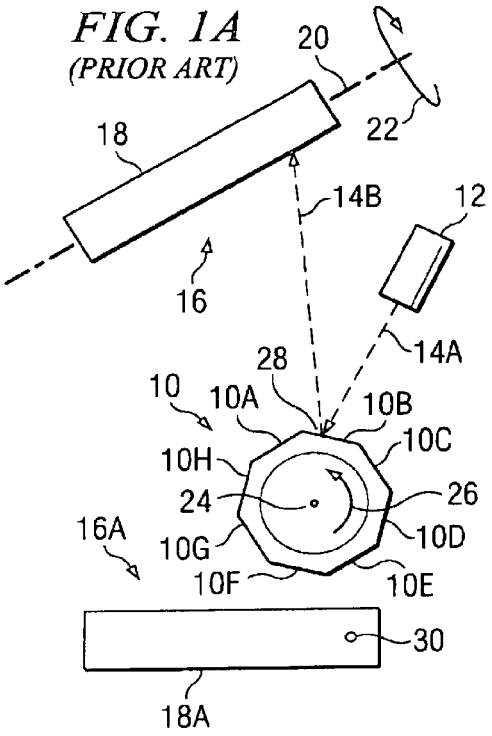
FIG. 1A (PRIOR ART)
FIGS. 1A, 1B, and 1C illustrate the use of a rotating polygon mirror for generating the sweep of a laser printer according to the prior art.
Figure 1B:
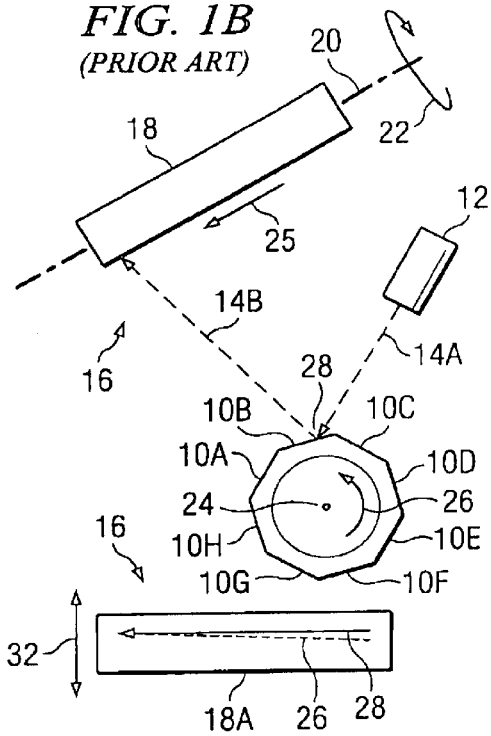
FIG. 1B (PRIOR ART)
Figure 1C:
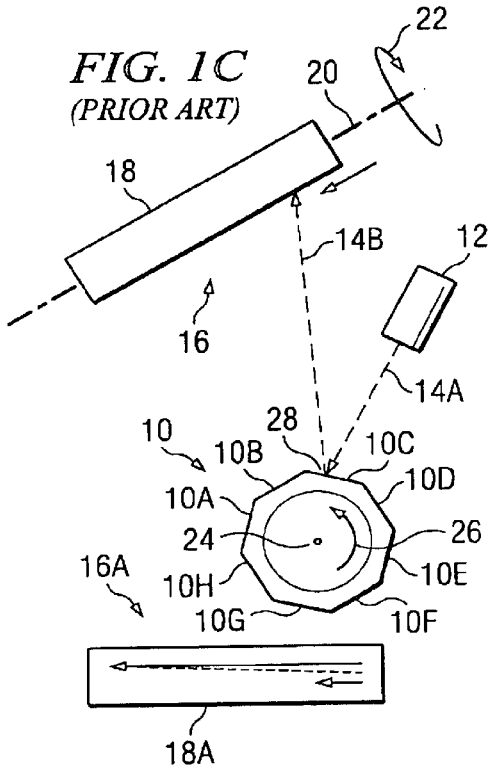
FIG. 1C (PRIOR ART)

Referring now to FIGS. 1A, 1B and 1C, there is shown an illustration of the operation of a prior art printer using a rotating polygon mirror. As shown in FIG. 1A, there is a rotating polygon mirror 10 which in the illustration has eight reflective surfaces 10A–10H. A light source 12 produces a beam of light, such as a laser beam, that is focused on the rotating polygon mirror so that the beam of light from the light source 12 is intercepted by the facets 10A–10H of rotating polygon mirror 10. Thus the laser beam of light 14A from the light source 12 is reflected from the facets 10A–10H of the polygon mirror 10 as illustrated by dashed line 14B to a moving photosensitive medium 16 such as a rotating photosensitive drum 18 having an axis of rotation 20. The moving photosensitive medium 16 or drum 18 rotates around axis 20 in a direction as indicated by the arcurate arrow 22 such that the area of the moving photosensitive medium 16 or drum 18 exposed to the light beam 14B is continuously changing. As shown in FIG. 1A, the polygon mirror 10 is also rotating about an axis 24 (axis is perpendicular to the drawing in this view) as indicated by the second arcurate arrow 26. Thus, it can be seen that the leading edge 28 of facet 10B of rotating polygon mirror 10 will be the first part of facet 10B to intercept the laser beam of light 14A from the light source 12. As the mirror 10 rotates, each of the eight facets of mirror 10 will intercept the light beam 14A in turn. As will be appreciated by those skilled in the art, the optics to focus the light beam, the lens system to flatten the focal plane to the photosensitive drum, and any fold mirrors to change the direction of the scanned beam are omitted for ease of understanding.

Illustrated below the rotating polygon mirror 10 is a second view of the photosensitive medium 16 or drum 18A as seen from the polygon scanner. As shown by reference number 30 on the photosensitive drum view 18A, there is the beginning point of an image of the laser beam 14B on medium 18A immediately after the facet 10B intercepts the light beam 14A and reflects it to the moving photosensitive medium 16 or drum 18.

Referring now to FIG. 1B, there is shown substantially the same arrangement as illustrated in FIG. 1A except the rotating polygon mirror 10 has continued its rotation about axis 24 such that the facet 10B has rotated so that its interception of the laser beam 10A is about to end. As will also be appreciated by those skilled in the art, because of the varying angle the mirror facets present to the intercepted light beam 14A, the reflected light beam 14B will move across the surface of the rotating drum as shown at 25 and 26 in FIG. 1B.

However, it will also be appreciated that since rotating drum 18 was moving orthogonally with respect to the scanning movement of the light beam 14B, that if the axis of rotation 24 of the rotating mirror was exactly orthogonal to the axis 20 of the rotating photosensitive drum 18, an image of the sweeping or scanning light beam on the photosensitive drum would be recorded at a slight angle. As shown more clearly by view 18A of the photosensitive drum, dashed line 26 illustrates that the trajectory of the light beam 14B is itself at a slight angle, whereas the solid line 28 representing the resulting image on the photosensitive drum is not angled but orthogonal to the rotation or movement of the photosensitive medium. To accomplish this parallel printed line image 28, the rotating axis 24 of the polygon mirror 10 is typically mounted at a slight tilt with respect to the rotating photosensitive drum 18 so that the amount of vertical travel or distance traveled by the light beam along vertical axis 32 during a sweep or scan across medium 16 is equal to the amount of movement or rotation of the photosensitive medium 16 or drum 18. Alternately, if necessary, this tilt can also be accomplished using a fold mirror that is tilted.

FIG. 1C illustrates that facet 10B of rotating polygon mirror 10 has rotated away from the light beam 14A, and facet 10C has just intercepted the light beam. Thus, the process is repeated for a second image line. Continuous rotation will of course result in each facet of rotating mirror 10 intercepting light beam 14 so as to produce a series of parallel and spaced image lines which when viewed together will form a line of print or other image.

It will be further appreciated by those skilled in the laser printing art, that the rotating polygon mirror is a very precise part or component of the laser printer that must spin at terrific speeds without undue wear of the bearings even for rather slow speed printers. For high speed printers, the complex and heavy polygonal scanning mirror requires significantly greater speeds with very advanced and robust bearings. The cost differential of manufacturing polygon mirrors that operate at significantly different speeds is so great, that to be economically effective, the use of different mirrors for different speed printers is required. Therefore, it would be desirable if a less complex flat mirror, such as for example a resonant flat mirror, could be used to replace the complex and heavy polygonal scanning mirror.

Figure 2A:
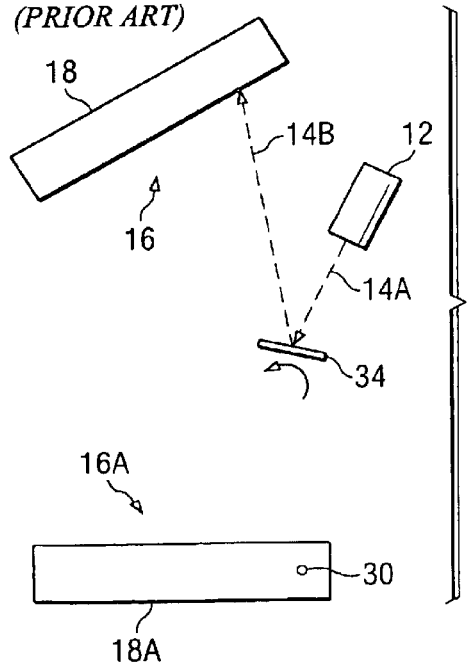
FIG. 2A (PRIOR ART)
FIGS. 2A, 2B, 2C, and 2D illustrate a prior art example of using a single axis flat resonant mirror to generate a unidirectional beam sweep of a laser printer.
Figure 2B:
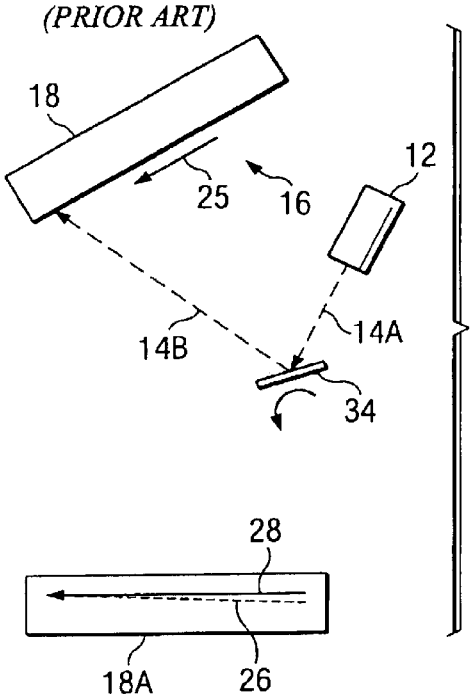
FIG. 2B (PRIOR ART)
Figure 2C:
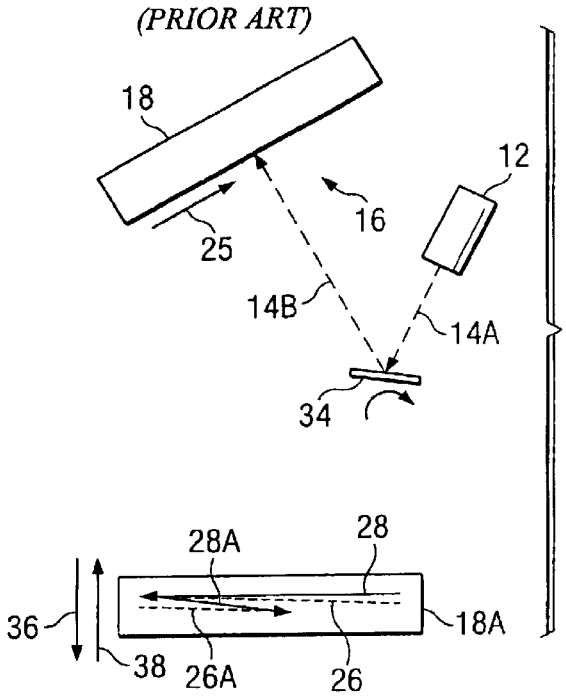
FIG. 2C (PRIOR ART)
Figure 2D:
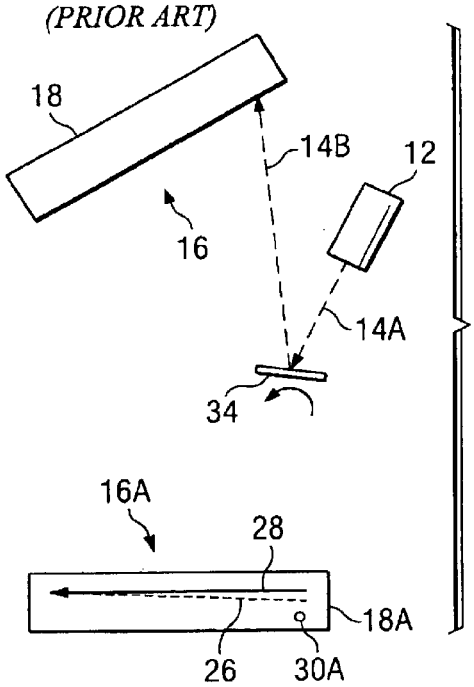
FIG. 2D (PRIOR ART)

Referring now to FIGS. 2A, 2B, 2C and 2D, there is illustrated a prior art example of a laser printer using a single-axis oscillating mirror to generate the beam sweep. As will be appreciated by those skilled in the art and as illustrated in the following figures, the oscillating mirror is perfectly capable of generating a bi-directional beam sweep. However, because of the non-parallel image line generated by the second or return sweep, and as will be discussed below, prior art efforts have typically been limited to only using one direction of the oscillating beam sweep. As shown in FIGS. 2A, 2B, 2C and 2D, the arrangement is substantially the same as shown in FIGS. 1A, 1B and 1C except that the rotating polygon mirror has been replaced with a single oscillating flat mirror 34. As was the case with respect to FIG. 1A, FIG. 2A illustrates the beginning of a beam sweep by the single axis mirror 34. Likewise, FIG. 2B illustrates the beam sweep as mirror 34 substantially completes its scan and, as illustrated at the photosensitive drum view 18A, according to this embodiment, the mirror 34 is mounted at a slight angle such that the beam sweep is synchronized with the movement of the rotating drum 18 so that the distance the medium moves is equal to the vertical distance the light beam moves during a sweep. As was the case in FIG. 1B, the slightly angled trajectory as illustrated by reference number 26 results in a horizontal image line 28 on the moving photosensitive medium 16 or drum 18A.

Thus, up to this point, it would appear that the flat surface single torsional axis oscillating mirror 34 should work at least as well as the rotating polygon mirror 30 as discussed with respect to FIGS. 1A, 1B, and 1C. However, when the oscillating mirror starts pivoting back in the opposite direction as shown by reference number 26A in FIG. 2C, with prior art scanning mirror printers, it was preferable to turn the beam 14A off and not print during the return sweep since the vertical movement of the mirror resulting from being mounted at a slight angle and the movement of the moving photosensitive medium 16 or rotating drum 18 will be cumulative rather than subtractive. Consequently, the angled trajectory 26 of the beam and movement of the medium would result in a printed image line 28A which is at even a greater angle than what would occur simply due to the movement of the rotating photosensitive drum 18. This is, of course, caused by the fact that as the beam sweep returns, it will be moving in a downward direction rather than an upward direction as indicated by arrow 36, whereas the photosensitive drum movement is in the upward direction indicated by arrow 38. Thus, as stated above, the movement of the drum and the beam trajectory are cumulative. Therefore, for satisfactory printing by a printer having lower resolution, it will be appreciated that the light beam and the printing were typically interrupted and/or stopped during the return trajectory of the scan. Thus, the oscillating mirror 34 was required to complete its reverse scan and then start its forward scan again as indicated at 30A, at which time the modulated laser was again turned on and a second image line printed. Thus, it will be appreciated that although the oscillating flat mirror 34 may be somewhat less expensive than the rotating polygon mirror and is also much lighter in weight, if the scanning beam is used in only one direction, it is typically much less efficient in terms of duty cycle than polygon mirror printers. Further, when the more expensive paper drive mechanism to synchronously start and stop the paper drive is also considered, the prior art's use of flat scanning mirrors was not competitive.

Figure 3A:
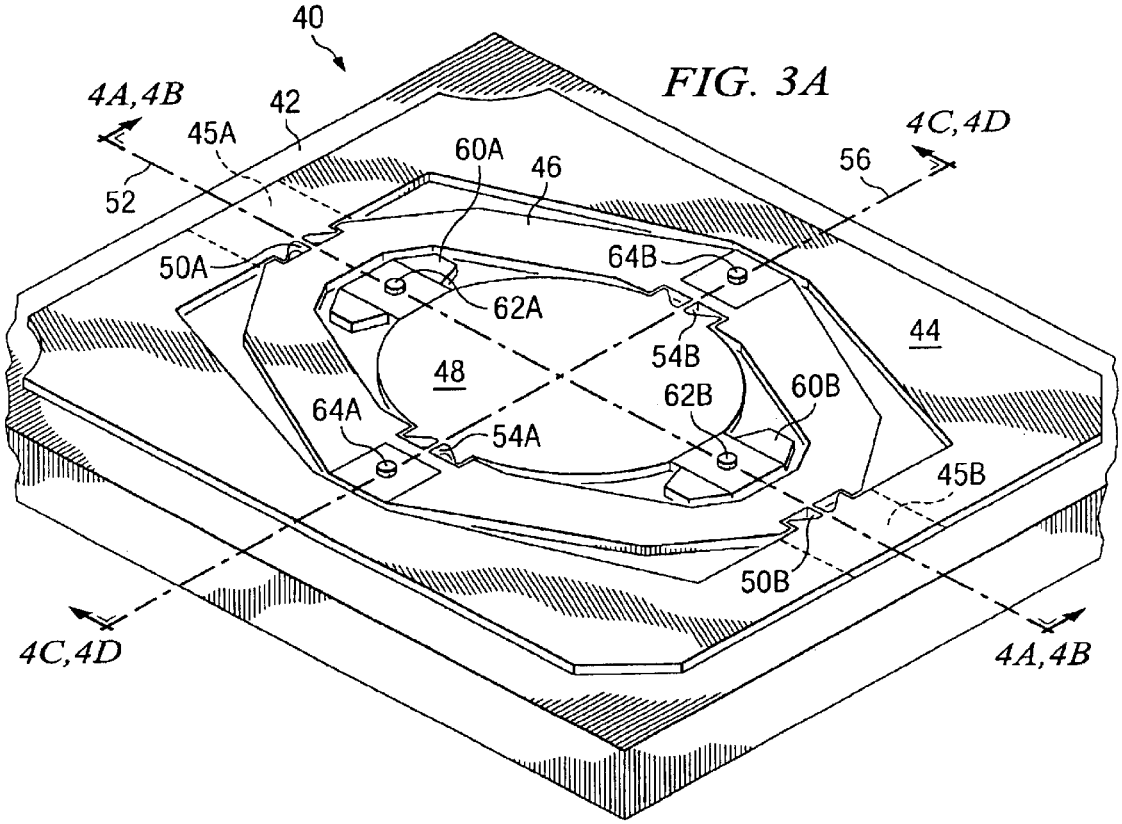
FIGS. 3A, 3B and 3C are perspective views of different embodiments of a two-axis torsional hinge mirror for generating the bi-directional beam sweep according to the teachings of embodiments of the present invention.

Referring now to FIG. 3A, there is shown a perspective view of a two-axis bi-directional mirror assembly 40 which may be used to provide a bi-directional beam sweep across a photosensitive medium wherein the beam sweep is also adjusted in a direction orthogonal to the oscillations of the mirror to maintain parallel printed image lines produced by a beam sweep in one direction and then in a reverse direction. As shown, moveable mirror assembly 40 is illustrated as being mounted on a support structure 42, and as being driven along both axis by electromagnetic forces. The moveable mirror assembly 40 may be formed from a single piece of substantially planar material and the functional or moving parts may be etched in the planar sheet of material (such as silicon) by techniques similar to those used in semiconductor art. As discussed below, the functional components include a support portion such as, for example, the frame portion 44, an intermediate gimbals portion 46 and an inner mirror portion 48. It will be appreciated that the intermediate gimbals portion 46 is hinged to the frame portion 44 at two ends by a first pair of torsional hinges 50A and 50B spaced apart and aligned along a first axis 52. Except for the first pair of hinges 50A and 50B, the intermediate gimbals portion 46 is separated from the frame portion 44. It should also be appreciated that, although frame portion 44 provides an excellent support for moving the device to support structure 42, it may be desirable to eliminate the frame portion 44 and simply extend the torsional hinges 50A and 50B and anchor the hinges directly to support structure 42 as indicated by anchors 45A and 45B shown in dotted lines on FIG. 3A.

The inner, centrally disposed mirror portion 48 having a reflective surface centrally located thereon is attached to gimbals portion 46 at hinges 54A and 54B along a second axis 56 that is orthogonal to or rotated 90° from the first axis. The reflective surface on mirror portion 48 is on the order of 110–400 microns in thickness, depending on the operating frequency, and is suitably polished on its upper surface to provide a specular or mirror surface. The thickness of the mirror is determined by the requirement that the mirror remain flat during scanning. Since the dynamic deformation of the mirror is proportional to the square of the operating frequency and proportional to the operating angle, higher frequency, larger angle mirrors require still stiffer mirrors, thus thicker mirrors. In order to provide necessary flatness, the mirror is formed with a radius of curvature greater than approximately 15 meters, depending on the wavelength of light used to expose the photosensitive drum. The radius of curvature can be controlled by known stress control techniques such as by polishing on both opposite faces and deposition techniques for stress controlled thin films. If desired, a coating of suitable material can be placed on the mirror portion to enhance its reflectivity for specific radiation wavelengths.

Figure 3B:
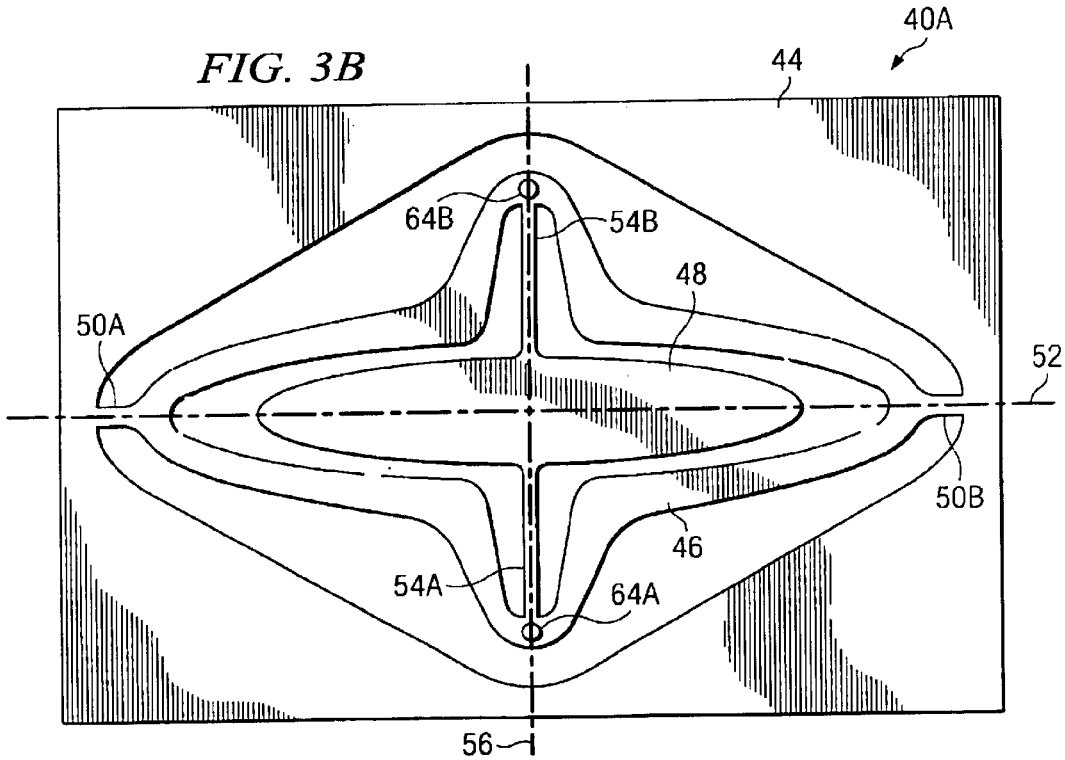

Referring now to FIG. 3B, there is a top view illustration of a long oval shaped dual axis mirror apparatus 40 suitable for use to provide resonant oscillations for generating the repetitive beam sweep. An example of such a long oval shaped mirror portion 48 found to be satisfactory has a long axis of about 4.0 millimeters and a short axis of about 1.5 millimeters. Except for the drive circuitry that creates the resonant oscillations which provide the repetitive beam sweep, the functional parts of this embodiment are the same as that discussed with respect to FIG. 3A and, therefore, carry the same reference numbers. Because of the advantageous material properties of single crystalline silicon, MEMS based mirror such as FIG. 3B, have a very sharp torsional resonance. The Q of the torsional resonance typically is in the range of 100 to over 1000. This sharp resonance results in a large mechanical amplification of the mirror's motion at a resonance frequency versus a non-resonant frequency. Therefore, according to one embodiment of this invention, it may be advantageous to pivot a mirror about the scanning axis at the resonant frequency. This reduces the needed drive power dramatically.

It should be obvious to one skilled in the art that there are many combinations of drive mechanisms for the scan axis and for the substantially orthogonal or cross scan axis. The mirror mechanical motion in the scan axis is typically greater than 15 degrees and may be as great as 30 degrees, whereas movement about the cross scan axis may be less than 1 degree. Since pivoting about the scan axis must move through a large angle and the mirror is long in that direction, electromagnetic or inertial drive methods for producing movement about the scan axis have been found to be effective. Inertial drive involves applying a small rotational motion at or near the resonant frequency of the mirror to the whole silicon structure which then excites the mirror to resonantly pivot or oscillate about its torsional axis. In this type of drive a very small motion of the whole silicon structure can excite a very large rotational motion of the mirror. For the cross scan or orthogonal axis, since a very small angular motion is required, electromagnetic force similar to that used in FIG. 3A may be used to produce the more controlled movement about the torsional hinges 50A and 50B to orthogonally move the beam sweep to a precise position. Consequently, a set of permanent magnet sets are only associated with the movement about hinges 50A and 50B. Further, although an oval-shaped mirror has been found to be particularly suitable, it will be appreciated that the mirror could have other shapes such as for example, round, square, rectangular, or some other shape.

Figure 3C:
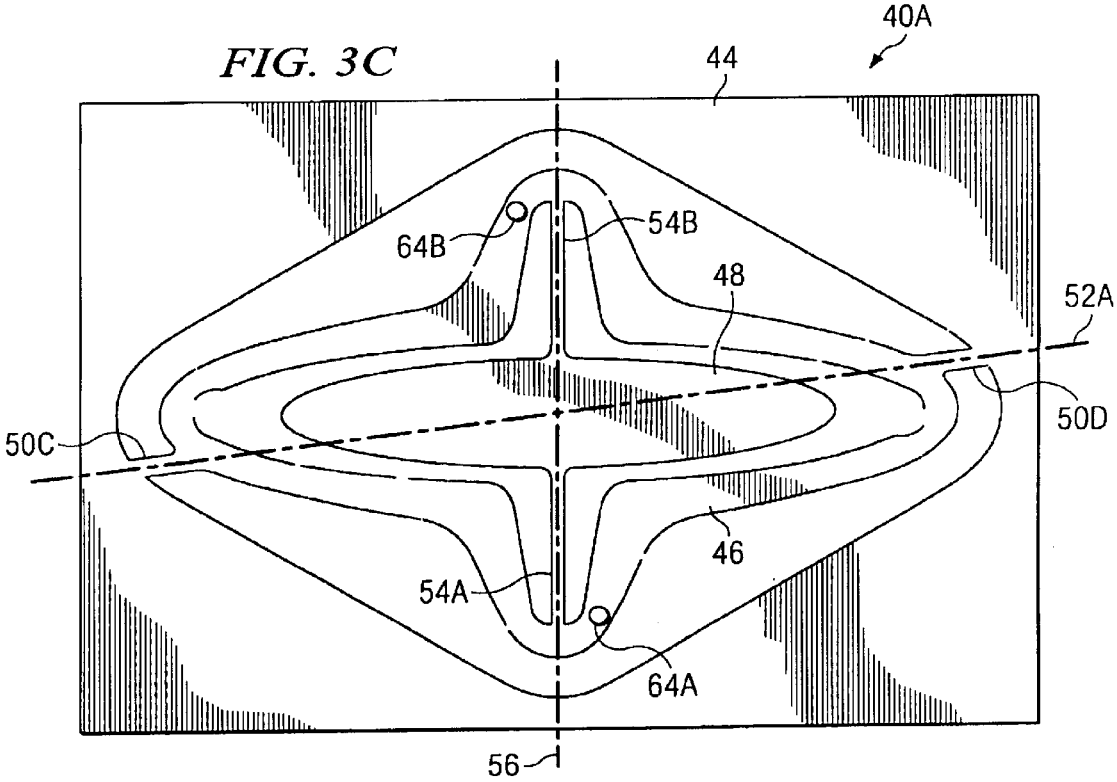

Referring now to FIG. 3C, there is shown an illustration of an oval shaped mirror device similar to that shown in FIG. 3B, except that the second set of hinges 50C and 50D are offset slightly from being orthogonal to the resonant hinges 54A and 54B. Thus, a rotation around hinges 50C and 50D results in movement that is not quite orthogonal to axis 56. This is illustrated by axis 52A.

Figure 4A:
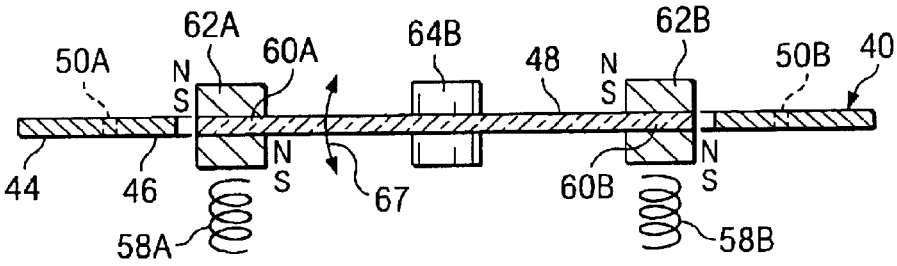
FIGS. 4A–4D are cross-sectional views of FIG. 3A illustrating rotation or pivoting of the two sets of torsional hinges.
Figure 4B:
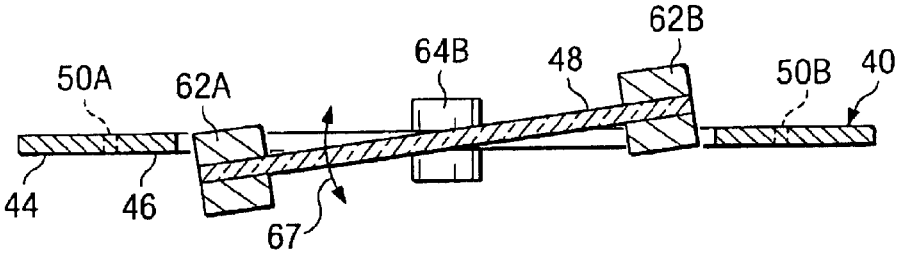

Referring to FIGS. 4A and 4B along with FIG. 3A, mirror assembly 40 may typically include a pair of serially connected electrical coils 58A and 58B under tabs 60A and 60B respectively to provide an electromagnetic drive for the beam sweep. Thus by energizing the coils with alternating positive and negative voltage at a selected frequency, the mirror portion 48 can be made to oscillate at that frequency. As mentioned above, to facilitate the electromagnetic drive, mirror assembly 40 may also include a first pair of permanent magnets 62A and 62B mounted on tabs 60A and 60B of mirror portion 48 along the first axis 52. Permanent magnet sets 62A and 62B symmetrically distribute mass about the axis of rotation 56 to thereby minimize oscillation under shock and vibration, each permanent magnet 62A, 62B preferably comprises an upper magnet set mounted on the top surface of the mirror assembly 40 using conventional attachment techniques such as adhesive or indium bonding and an aligned lower magnet similarly attached to the lower surface of the mirror assembly 40 as shown in FIGS. 4A and 4B. The magnets of each set are arranged serially such as the north/south pole arrangement indicated in FIG. 4A. There are several possible arrangements of the four sets of magnets which may be used, such as all like poles up; or two sets of like poles up, two sets of like poles down; or three sets of like poles up, one set of like poles down, depending upon magnetic characteristics desired.

Figure 4C:
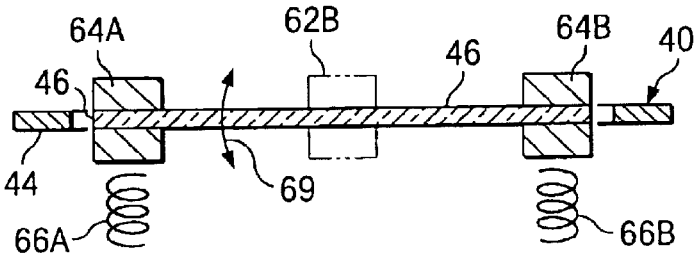
Figure 4D:
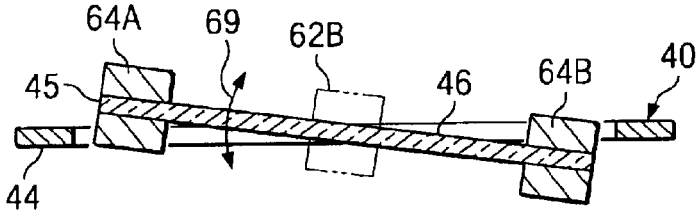

Referring now to FIGS. 4C and 4D along with FIG. 3A, gimbals portion 46 is mounted to frame portion 44 by means of hinges 50A and 52B. Motion of the gimbals portion 46 about the first axis 52 as illustrated in FIG. 3A is provided by another pair of serially connected coils 66A and 66B. As has been mentioned, pivoting about axis 52 will provide the vertical motion necessary to maintain consecutive printed image lines parallel to each other, and is facilitated by permanent magnet sets 64A and 64B.

The middle or neutral position of mirror assembly 40 of FIG. 3A is shown in FIG. 4A, which is a section taken through the assembly along line 3A—3A (or axis 52) of FIG. 3A. Rotation of mirror portion 48 about axis 56 independent of gimbals portion 46 and/or frame portion 44 is shown in FIG. 4B as indicated by arrow 67. FIG. 4C shows the middle position of the mirror assembly 40, similar to that shown in FIG. 4A, but taken along line 3C—3C (or axis 56) of FIG. 3A. Rotation of the gimbals portion 46 (which supports mirror portion 48) about axis 52 independent of frame portion 44 is shown in FIG. 4D as indicated by arrow 69. The above arrangement allows independent rotation of mirror portion 48 about the two axes which in turn provides the ability to direct the oscillating beam onto the moving photosensitive medium 16 or drum 18 and still produce parallel image lines.

As mentioned above, other drive circuits for causing resonant pivoting of the mirror device around torsional hinges 54A and 54B may be employed. These drive sources include piezoelectric drives and electrostatic drive circuits. Piezoelectric and electrostatic drive circuits have been found to be especially suitable for generating the resonant oscillation for producing the back and forth beam sweep.

Further, by carefully controlling the dimension of hinges 54A and 54B (i.e., width, length and thickness) the mirror may be manufactured to have a natural resonant frequency which is substantially the same as the desired oscillating frequency of the mirror. Thus, by providing a mirror with a resonant frequency substantially equal to the desired oscillating frequency, the power loading may be reduced. Unfortunately, it will also be appreciated that the power loading will be significantly increased if the mirror is forced to oscillate at a frequency that is substantially different than the resonant frequency. Consequently, it will be understood that offering a series of these prior art resonant scanning mirror printers that operate at significantly different speeds for sale, required different mirrors for each of the different print speeds.

Figure 5A:
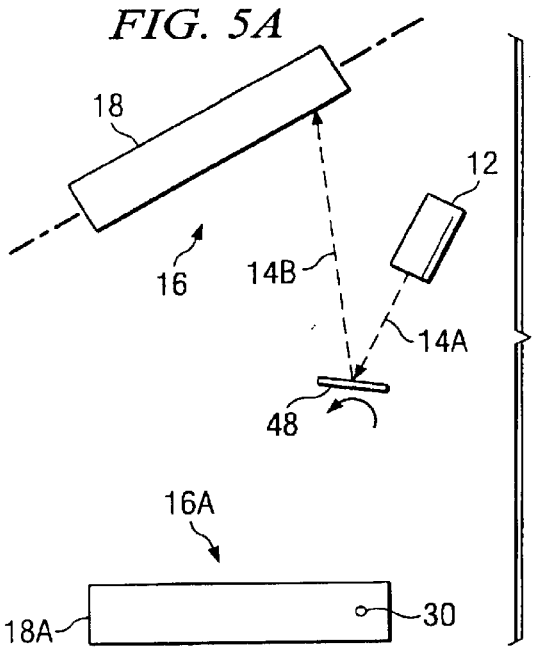
FIGS. 5A, 5B, and 5C illustrate the use of one two-axis resonant mirror such as is shown in FIGS. 3A and 3B to generate a bi-directional beam sweep of a laser printer according to teachings of the present invention.
Figure 5B:
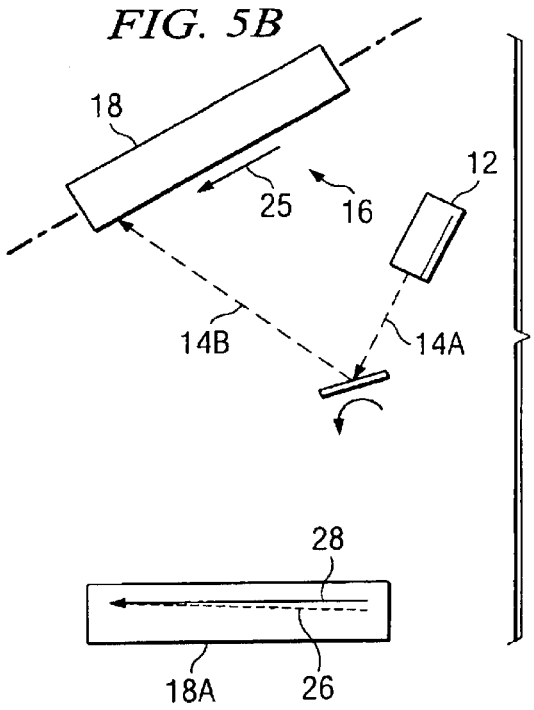
Figure 5C:
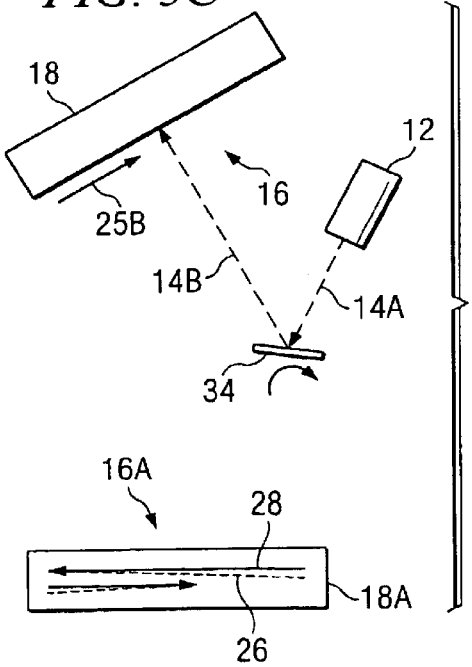

FIGS. 5A, 5B and 5C illustrate the use of a dual axis scanning resonant mirror such as shown in FIGS. 3A or 3B according to one embodiment of the present invention. As can be seen from FIGS. 5A and 5B, the operation of dual orthogonal scanning mirror assembly 40 as it scans from right to left in the FIGS. is substantially the same as mirror 34 pivoting around a single axis as discussed and shown in FIGS. 2A and 2B. However, unlike the single axis mirror 34 and as shown in FIG. 5C, the laser (light beam 14B) is not turned off on the return scan, such that a return or left to right scan in the FIGS. 5A, 5B and 5C can be continuously modulated during the return scan to produce a printed line of images on the moving photosensitive medium 16. The second printed line of images, according to the present invention, will be parallel to the previous right to left scan by slight pivoting of the mirror 48 around axis 52 of the dual axis mirror as was discussed above.

Figure 6:
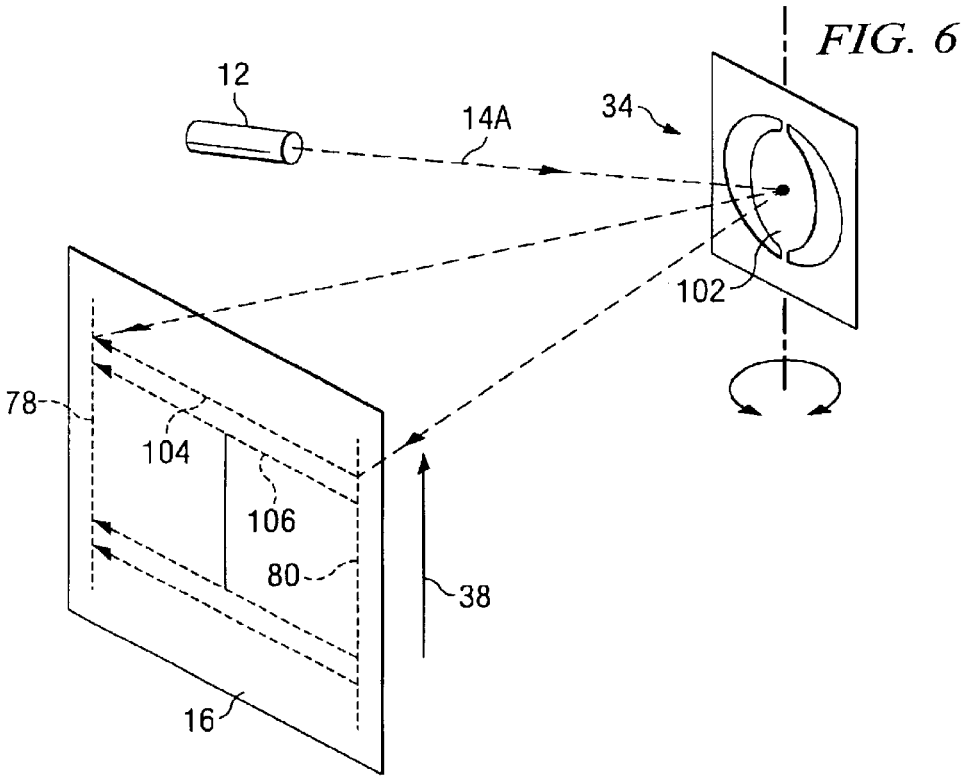
FIG. 6 is a perspective illustration of the use of one single axis mirror such as shown in FIGS. 8A and 8B to generate the single directional beam sweep of a laser printer according to the teachings of another embodiment of the present invention.
Figure 8A:
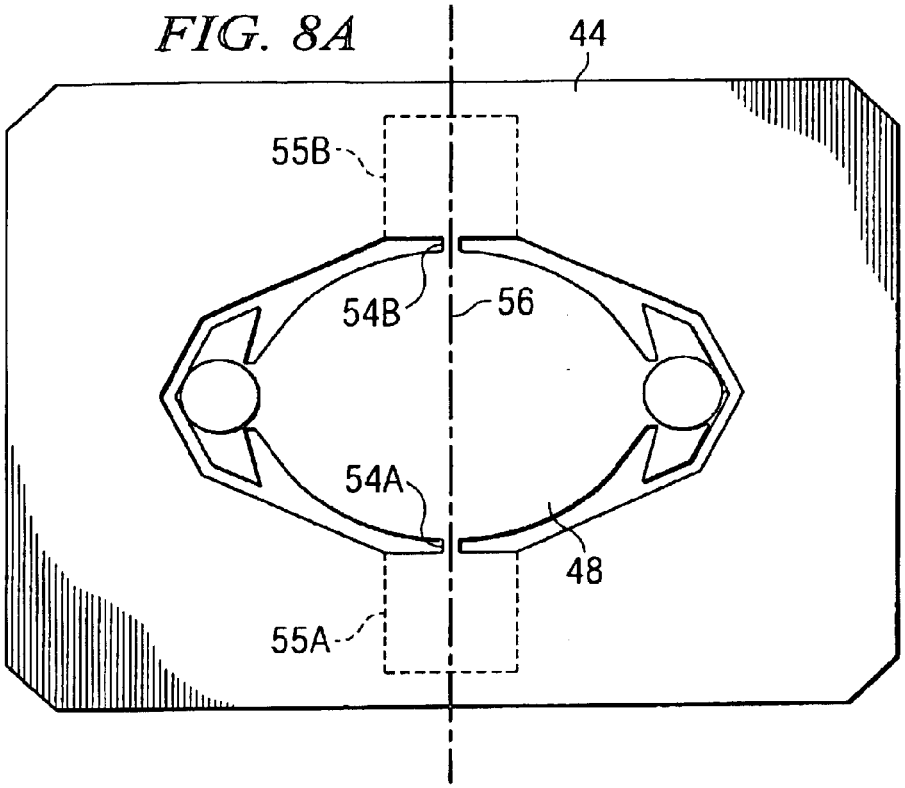
FIGS. 8A and 8B are embodiments of single axis analog torsional hinge mirrors.
Figure 8B:
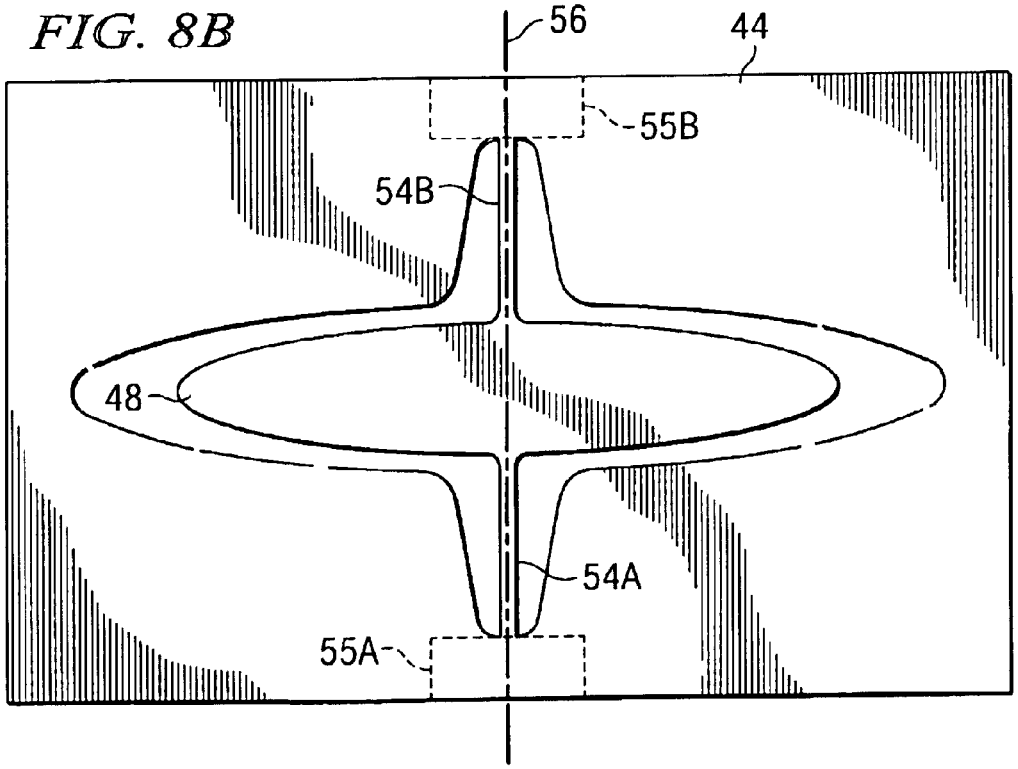

FIG. 6 illustrates a perspective illustration of embodiment of the present invention using a single mirror which pivots about a single axis, such as the single axis mirror shown in FIGS. 8A and 8B. The reflecting surface 102 of the single axis mirror 34 receives the light beam 14A from source 12 and provides the right to left and left to right resonant sweep between limits 78 and 80 as discussed with respect to FIGS. 2A, 2B, 2C and 2D. This left to right beam sweep provides the parallel lines 104 and 106 as the medium 16 moves in the direction indicated by arrow 38.

Figure 7:
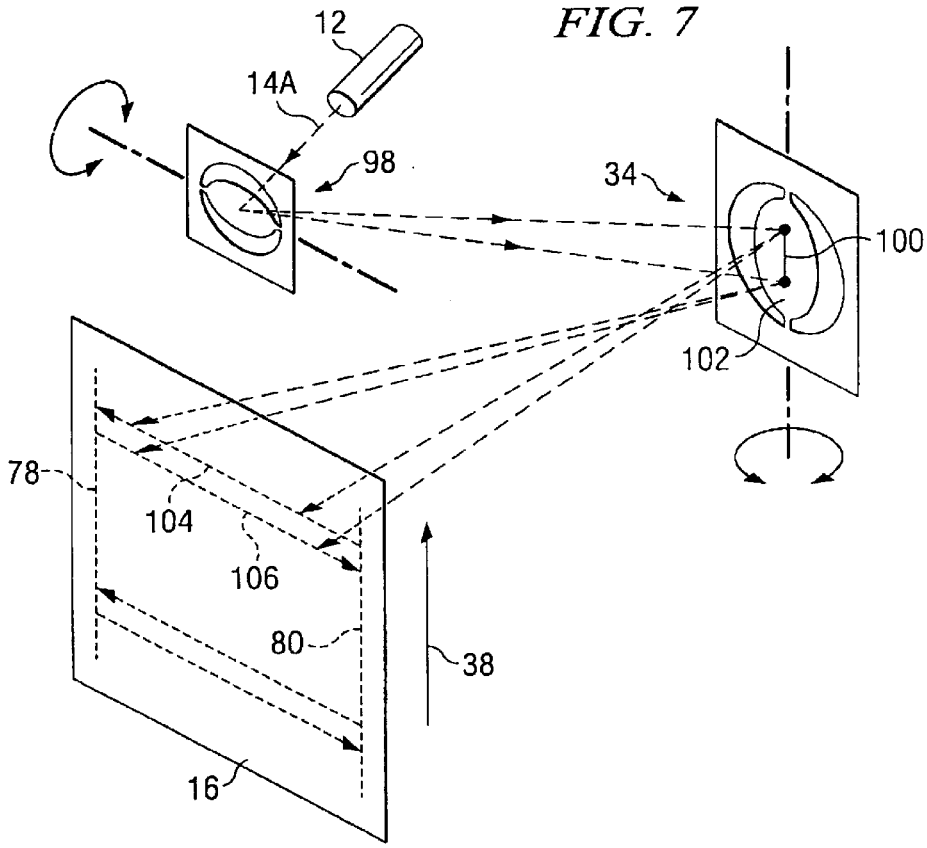
FIG. 7 is a perspective illustration of the use of two synchronized single axis mirrors of the type.

Referring to FIG. 7 there is a perspective illustration of another embodiment of the present invention using two mirrors which pivot about a single axis, such as the single axis mirrors shown in FIGS. 8A and 8B, rather than one dual axis mirror. In addition, two of the dual or two-axis mirrors of FIG. 3A can be used to obtain the same results as achieved by using two single axis mirrors. For example, two of the two-axis mirror arrangement shown in FIG. 3A may be used by not providing (or not activating) the drive mechanism for one of the axes. However, if two mirrors are to be used, it may be advantageous to use two of the more rugged single axis mirrors. That is, each mirror has only a single axis of rotation and a single pair of hinges 54A and 54B such as illustrated in FIGS. 8A and 8B.

Therefore, a single axis analog torsional hinged mirror may be used in combination with a second like single axis torsional mirror to solve the problem of non-parallel image lines generated by a resonant scanning mirror type laser printer as discussed above with respect to FIG. 2. One suitable arrangement would be to use the long oval mirror of FIG. 8B to provide a resonant beam sweep and the electromagnetic driven round mirror of FIG. 8A to provide the orthogonal movement. Alternately, the round mirror could be used to provide the resonant beam sweep and the elongated oval mirror can be used to provide orthogonal movement.

As shown in FIGS. 8A and 8B, a single axis mirror includes a support member 44 supporting a round mirror or reflective surface 48 as shown in FIG. 8A, or a long oval mirror or reflective surface 48 as shown in FIG. 8B, by the single pair of torsional hinges 54A and 54B. Thus, it will be appreciated that if the mirror portion 48 can be maintained in a resonant state by a drive source, the mirror can be used to cause an oscillating light beam to repeatedly move across a photosensitive medium. It will also be appreciated that an alternate embodiment of a single axis mirror may not require the support member or frame 44 as shown in both FIGS. 8A and 8B. For example, as shown in FIG. 8A, the torsional hinges 54A and 54B may simply extend to a pair of hinge anchors 55A and 55B as shown in dotted lines on FIG. 8A. These type of hinge anchors could also be used with the long oval shaped mirror of FIG. 8B.

As was mentioned above, the light beam may be moved in a direction orthogonal to the resonant oscillation if parallel lines of print are to be achieved. Therefore, referring again to FIG. 7, a second single axis mirror of the type shown in either FIG. 8A or 8B is used to provide the vertical or orthogonal movement of the light beam. The system of the embodiment of FIG. 7 uses the first single axis mirror 34 to provide the right to left, left to right resonant sweep as discussed with respect to FIGS. 2A, 2B, 2C and 2D. However, the up and down or orthogonal control of the beam trajectory is achieved by locating the second single axis mirror 98 to intercept the light beam 14A emitted from light source 12 and then reflecting the intercepted light to the mirror 34 which is providing the resonant sweep motion. Line 100 shown on mirror surface 102 of resonant mirror 34 illustrates how mirror 98 moves the light beam 14A up and down on surface 102 during the left to right and right to left beam sweep so as to provide parallel lines 104 and 106 on the moving medium 16. It will also be appreciated that the position of the mirror providing the resonant sweep and the mirror providing up and down motion to maintain parallel lines could be switched.

To this point there has been discussed various methods and arrangements for using resonant scanning mirrors as the drive engine for laser printers, and that prior to the present invention scanning mirrors with different resonant frequencies were used for different speed printers. The significant cost difference of polygon mirrors used for slower speed printers and high speed printers was also discussed as the reason for not using a single high speed polygon mirror as the engine to drive printers of all different speeds. That is, the robust bearings necessary for the very high speed operation required by high printer speeds may be over designed for the slower operation of the slower printers, but the bearings can certainly handle a lower speed. Consequently, the reason for not using a high speed mirror at a speed significantly less than its capabilities is the excessive cost even when additional inventory costs are considered.

The manufacturing cost of a high frequency resonant scanning mirror, however, is substantially the same as the manufacturing cost of a significantly slower frequency resonant scanning mirror. Further, as was also discussed, resonant scanning mirrors cannot be effectively oscillated at a frequency different (slower or faster) than the frequency for which they are designed. However, according to the method of the present invention, a resonant scanning mirror designed for a high speed printer can be efficiently and cost effectively used with printers that have a significantly lower print speed. Therefore, using the method and corresponding apparatus of the present invention, a scanning mirror having a high resonant frequency suitable for providing high quality printing at high speeds can be used as the scanning mirror of printers that print at significantly lower speeds. Simply stated, this is accomplished by oscillating the mirror at the high resonate frequency for which it was designed while moving the photosensitive medium or paper at the desired slower speed and reducing the height or vertical dimension of the addressable pixel by a ratio equal to the maximum page print speed (e.g. pages per minute) to the actual print speed. Alternately, this step of the process can be expressed as increasing the number of print lines per inch by the inverse ratio of the maximum print speed of the mirror to the desired print speed.

Figure 9A:
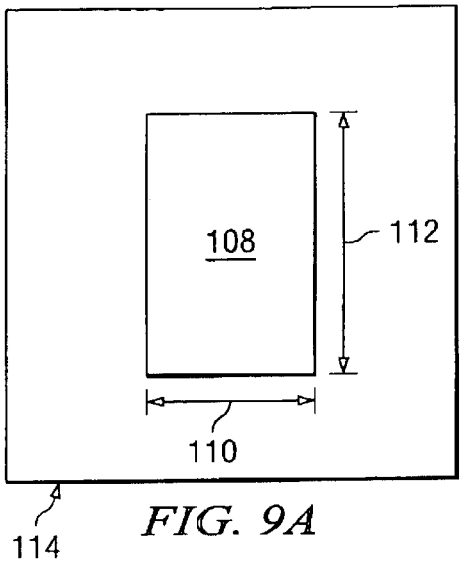
FIGS. 9A and 9B illustrate the laser spot size and relative pixel sizes for a maximum print speed and a reduced print speed respectively.
Figure 9B:
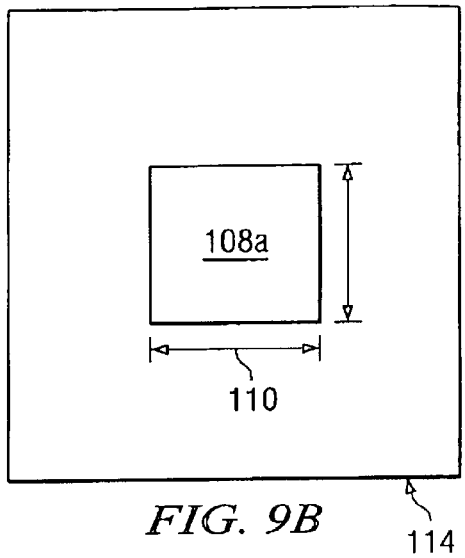

Referring now to FIG. 9A there is shown, for example only, an illustration of a single addressable pixel 108, which when combined with other pixels makes up an image. The width of addressable pixel 108 as indicated by the double headed arrow 110 and the height of the pixel 108 as indicated by double headed arrow 112 also illustrates the horizontal and vertical separation respectively between the centroids of horizontally adjacent pixels and vertically adjacent pixels. The area 114 represents the spot size of the laser beam on the photosensitive medium. It should be understood at this point that laser spot will actually be a circle or oval shape rather than the rectangular shape indicated by area 114. However, use of the rectangular area 114 to represent a laser beam spot simplifies the explanation. In the example of FIG. 9A, the horizontal dimension of the addressable pixels as substantially represented by the double headed arrow 108 will remain constant since the scanning frequency of the mirror remains constant. The vertical dimension of the pixel in FIG. 9A, as substantially represented by the double headed arrow 112, represents the vertical dimension of addressable pixel when the printer is operating at the maximum printer speed (i.e. maximum pages per minute). However, unlike the horizontal dimension of the pixels, as discussed above and as will be discussed further with respect to FIG. 9B, the pixel vertical dimension represented by arrow 112 will change as a direct ratio function of the print speed. As an example only, if the number of pages printed per minute is reduced to one half the maximum possible pages per minute that can be printed, the vertical pixel dimension will also be reduced by one half. It is also important to note that the addressable pixel 108 size is substantially smaller (e.g. three to four times smaller) than the rectangle 114 representing a single laser spot. Referring to FIG. 9B, there is an illustration similar to FIG. 9A, except that the addressable pixel size indicated at 108a is smaller by about one third than pixel 108 of FIG. 9A representing that the print speed (pages per minute) has also been reduced by about one third of that of FIG. 9A. Thus, as shown, the separation or distance between adjacent horizontal pixels (alternately, the horizontal dimension of the pixel) represented by double headed arrow 110 is the same as in FIG. 9A. Likewise the laser beam spot size 114 is the same. However, since the size of addressable pixel 108 has been reduced by about one third, the separation between adjacent vertical pixels represented by double headed arrow 112*a* has also been reduced by about one third. Thus, the scanning speed of the mirror is constant no matter the printing speed (pages per minute), and only the vertical separation between addressable pixels (alternately stated as the number of scan lines or image lines per inch) is changed. In this example, the vertical separation between pixels will be decreased by one third. Alternately, this can be expressed as the number of image lines being increased by one third. Using a constant scanning speed regardless of the pages per minute being printed provides other advantages in addition to reducing the inventory of different mirrors. For example, a common mirror drive and a common optical cavity may be used for all printer speeds. In addition, the photo chemistry is the same for all printers and does not have to be adjusted for different printer speed points.

Figure 10A:
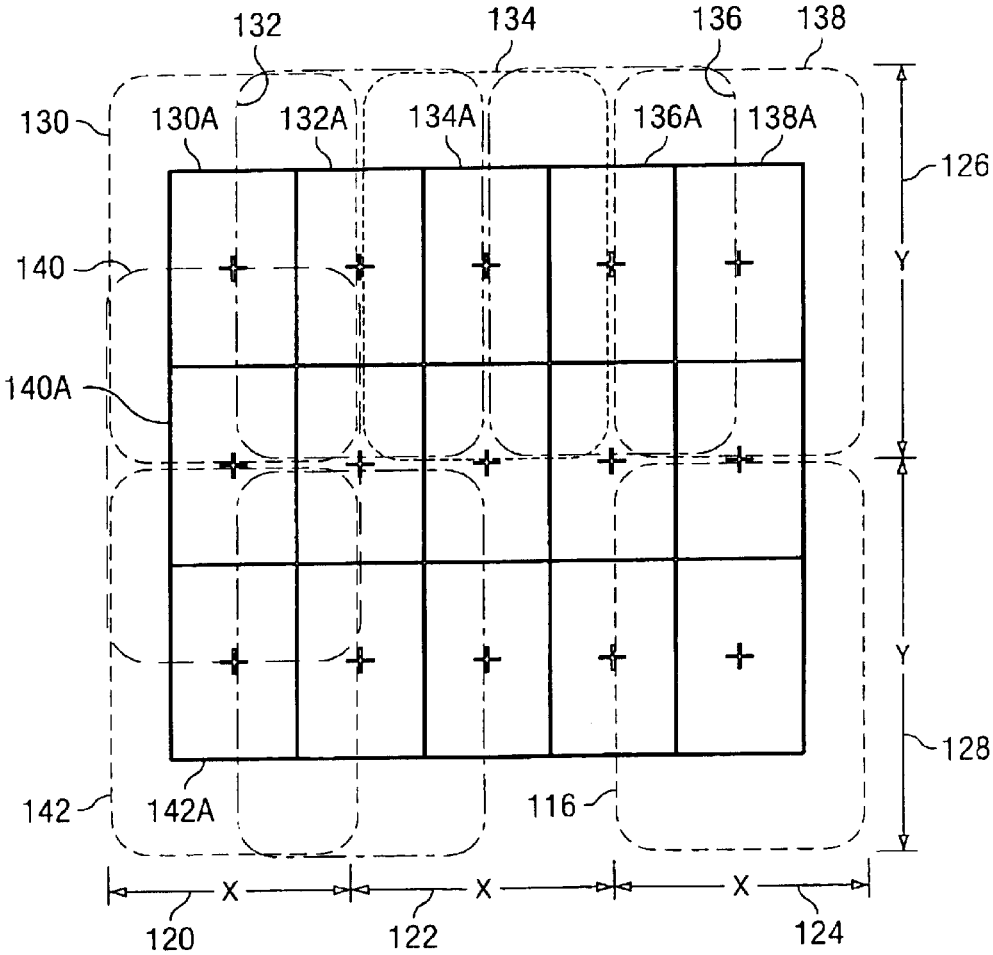
FIGS. 10A and 10B illustrate pixel resolution of two embodiments according to the present invention.
Figure 10B:
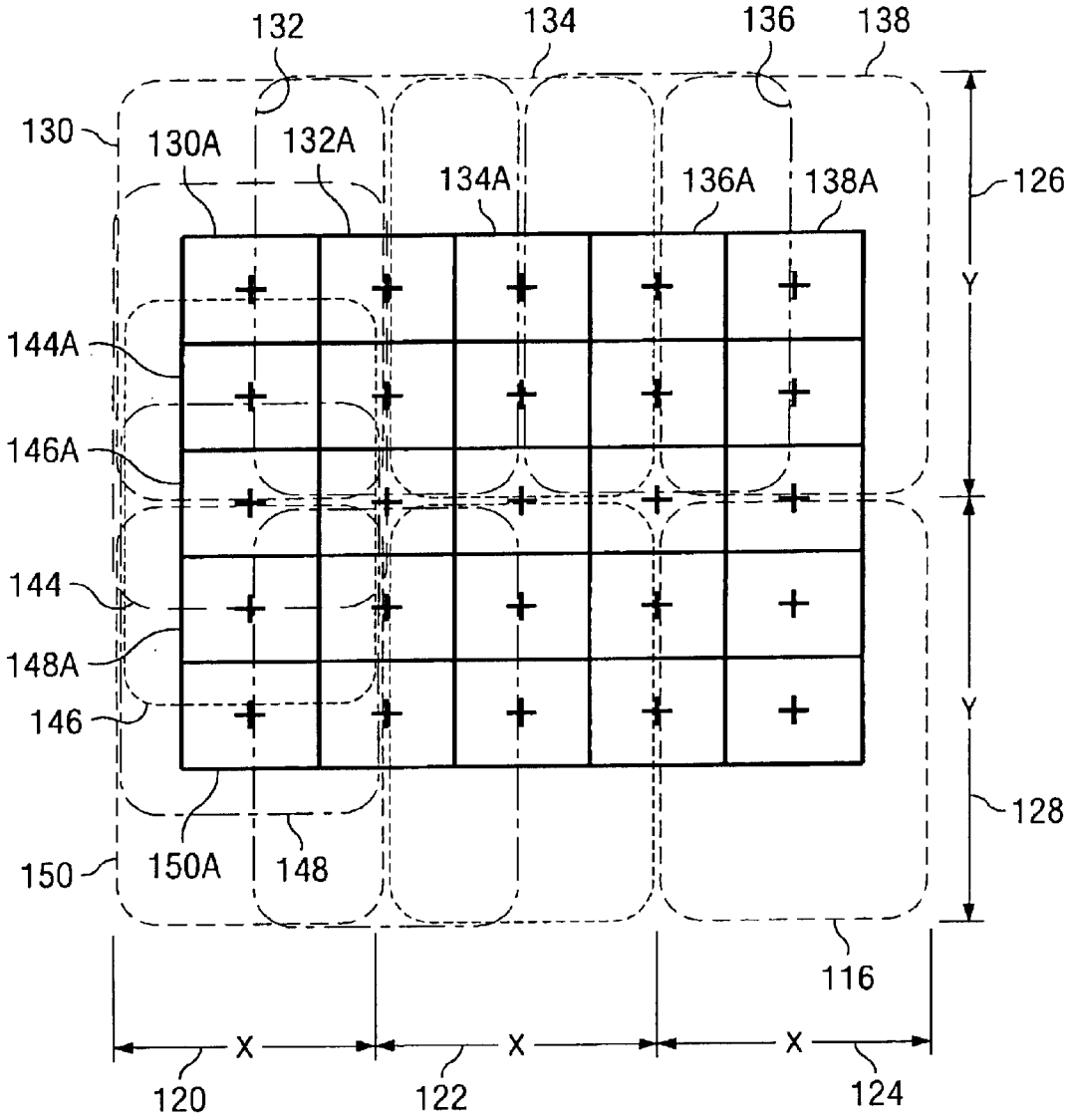

This concept is visually illustrated in the examples of FIGS. 10A and 10B. The parameters were selected for convenience only to aid understanding of the invention. Therefore, in the examples illustrated, FIG. 10A represents a comparison of the addressable pixel size and the beam or laser spot size of a printer printing at a maximum rate of 50 pages per minute, whereas FIG. 10B is a similar comparison for the same multispeed printers or a different printer using the same resonant frequency scanning mirror that prints at a rate of 30 pages per minute. It is assumed that the addressable pixel size across the page (horizontal) for both FIGS. 10A and 10B is about 1200 dots/inch which, as will be appreciated by those skilled in the art, is about the commercial norm today and rapidly moving to 2400 dots/inch. Similarly, the vertical addressable pixel size is also assumed to be about 1200 dots or lines per inch in FIG. 10B, and two thirds that or about 800 dots or lines per inch in FIG. 10A. The laser or beam spot made on the photosensitive medium or paper by one addressable pixel in this example is assumed to be about four times that of the addressable pixel and will actually have a round or long oval shape rather than the substantially rectangular shape indicated by reference number 114 in FIGS. 9A and 9B or by reference number 116 in FIGS. 10A and 10B. Further, in the example of both FIGS. 10A and 10B, the horizontal dimension X of the beam spot is shown to be about two times the horizontal dimension of the addressable pixels. The vertical dimension Y of the beam spot is also about two times the vertical dimension of the addressable pixels in the illustration of FIG. 10A, and, as will be discussed further, about 3.3 times the vertical dimension of the addressable pixels in FIG. 10B. As discussed above, to provide properly proportioned images at a print speed less than the maximum available from a specific resonate mirror simply requires reducing the vertical size of the addressable pixels by the same ratio that the printing speed or pages per minute is reduced. Thus if the maximum print speed is 50 pages per minute and the same scanning mirror is to be used to print at 30 pages per minute (i.e. 60% of 50 pages), then the pixel vertical dimension of the addressable pixel size of the 30 pages per minute printer (FIG. 10B) will also be reduced to 60% of the pixel size of the 50 pages per minute printer (FIG. 10A) as shown. As discussed above, this concept may also be thought of as increasing the number of vertical pixels or lines per inch by the inverse ratio of the printing speeds. Therefore, if the 50 pages per minute printer uses 3 vertical addressable pixels or lines per inch, then using the inverse ratio, the 30 pages per minute printer will use 5 vertical addressable pixels or lines per inch.

Referring again to FIGS. 10A and 10B, it is seen that an area equivalent to 6 laser beam spots (3 across, as indicated by double headed arrows 120, 122 and 124, and two vertical, as indicated by double headed arrows 126 and 128 vertically) is printed by both the 50 pages per minute printer and the 30 pages per minute printer. However, as shown in both of the figures, the three laser spot or 3X horizontal dimension is printed with 5 laser spots 130, 132, 134, 136 and 138 by turning on the 5 horizontal addressable pixels 130*a*, 132*a*, 134*a*, 136*a* and 138*a* in a row. Similarly, the two laser spot or 2 Y vertical dimension of the 50 pages per minute printer of FIG. 10A is printed with 3 laser spots 130,

140 and 142 by turning on the 3 vertical addressable pixels 130*a*, 140*a* and 142*a*. In the same manner, the 2 laser spot or 2Y vertical dimension of the 30 pages per minute printer of FIG. 10B is printed with the 5 laser spots 130, 144, 146, 148 and 150 by turning on the 5 vertical addressable pixels 130*a*, 144*a*, 146*a*, 148*a* and 150*a*. It will be noted, that the actual area printed by the laser spots is greater than the addressable pixel area. However, at 1200 pixels per inch the horizontal separation between addressable pixel centroids is 0.000833 inches. So, even if both the horizontal and vertical dimensions of the laser spot are double that of the addressable pixel, the print over run will be no greater than about 0.000415 inches horizontally and about 0.000833 inches vertically as indicated in the figures.

Thus it will also be appreciated that the approach of this invention could also be considered as increasing the addressable pixel resolution in the vertical direction, although with the laser spot being considerably larger than the addressable pixel, such increased resolution may not result in better image quality. Further, non-integral ratio values work just as well as integral values. If integral values are used, the laser duty cycles may be forced to be equal over groups of addressable pixels, in which case the vertical resolution would be the same as for the maximum page speed printer. For example, if a printer has a maximum print speed of X pages per minute, and the page print speed is reduced to X/2 pages per minute, then the vertical resolution could, for example, go from 1200 lines per inch to 2400 lines per inch. However, if every addressable vertical pair of pixels were forced to the same laser duty cycle, the effective resolution is back to 1200 lines per inch. This concept is also illustrated in FIGS. 10A and 10B.

The foregoing descriptions of specific embodiments of the present invention have been presented for purposes of illustration and description. They are not intended to be exhaustive or to limit the invention to the precise forms disclosed as many modifications and variations are possible in light of the above teaching. The embodiments were chosen and described in order to best explain the principles of the invention and its practical application to thereby enable others skilled in the art to best utilize the invention and various embodiments with various modifications as are suited to the particular use contemplated. It is intended that the scope of the invention be defined by the claims appended hereto and their equivalents.

What is claimed is:

1. A method of printing images at a plurality of print speeds using a single frequency scanning mirror comprising the steps of:

providing a moving photosensitive medium;

providing a light beam;

intercepting said light beam at the reflective surface of said single frequency scanning mirror and redirecting said light beam toward said moving photosensitive medium;

oscillating said scanning mirror at said single frequency to sweep said redirected light beam across said moving photosensitive medium;

generating digital signals for modulating said provided light beam to produce a multiplicity of image lines to create a selective image, each of said multiplicity of image lines representing a selected number of addressable pixels per a selected unit of measurement;

moving said photosensitive medium at a selected speed; and adjusting the number of image lines generated per said selected unit of measurement as a function of said selected speed so as to produce an image with selected proportions.

2. The method of claim 1 wherein said selected speed is a single fixed speed.

3. The method of claim 1 wherein said selected speed is one of a plurality of fixed speeds.

4. The method of claim 1 wherein said step of providing a light beam comprises the step of providing a laser beam.

5. The method of claim 1 wherein said moving photosensitive medium is cylindrical-shaped and rotates about an axis through the center of said cylinder.

6. A method of printing images at a plurality of print speeds using a single frequency scanning mirror comprising the steps of:

providing a moving photosensitive medium;

providing a light beam;

intercepting said light beam at the reflective surface of said single frequency scanning mirror and redirecting said light beam toward said moving photosensitive medium;

oscillating said scanning mirror at said single frequency to sweep said redirected light beam across said moving photosensitive medium;

generating digital signals for modulating said provided light beam and for controlling addressable pixels comprising an image line, said digital signals generated at a rate based on said addressable pixels having a fixed horizontal dimension;

generating a multiplicity of said image lines based on said addressable pixels having a selected vertical dimension; and adjusting said vertical dimensions of said addressable pixels as a function of a selected print speed so that said printed image has selected proportions.

7. The method of claim 6 wherein said selected speed is a single fixed speed.

8. The method of claim 6 wherein said selected speed is one of a plurality of fixed speeds.

9. The method of claim 6 wherein said step of providing a light beam comprises the step of providing a laser beam.

10. A method of producing images at a plurality of rates using a single frequency scanning mirror comprising the steps of:

intercepting a light beam at the reflective surface of a single frequency scanning mirror and redirecting said light beam toward a photosensitive target;

oscillating said scanning mirror at said single frequency to sweep said redirected light beam across said photosensitive target;

generating digital signals for modulating said light beam to produce a multiplicity of image lines to create a selected image, each of said multiplicity of image lines representing a selected number of addressable pixels per a selected unit of measurement;

providing relative motion between said target and said sweeping redirected light beam, said motion being substantially orthogonal to said sweeping beam and at a selected speed;

adjusting the number of image lines generated per said selected unit of measurement as a function of said selected speed so as to produce an image with selected proportions.

11. The method of claim 10 wherein said produced image is a printed image and wherein said relative motion between said photosensitive target and said sweeping light beam is provided by moving said photosensitive target.

12. The method of claim 11 wherein said moving photosensitive target is a rotating drum.

13. The method of claim 10 wherein said produced image is an image on said photosensitive target and wherein said relative motion between said photosensitive target and said sweeping redirected light beam is provided by moving said sweeping beam orthogonally with respect to movement of said photosensitive target.

14. The method of claim 10 wherein said step of providing relative motion at a selected speed comprises the step of providing said relative motion at a single fixed speed.

15. The method of claim 10 wherein said step of providing relative motion at a selected speed comprises the step of providing said relative motion at a multiplicity of fixed speeds.

16. Apparatus for generating a modulated scanning beam for driving a printer having a moving photosensitive medium sensitive to said modulated scanning beam:

a single frequency scanning mirror for intercepting a light beam and redirecting said light beam toward said moving photosensitive medium;

drive circuitry for oscillating said scanning mirror at said single frequency to sweep said redirected light beam across said moving photosensitive medium;

circuitry for generating a multiplicity of image lines which combine to form a selected image, each of said multiplicity of image lines comprised of a selected number of addressable image pixels per a selected unit of measurement;

circuitry for generating said multiplicity of image lines at a selected rate, said rate determined as a function of the speed of movement of said photosensitive medium so as to produce a printed image with selected proportion.

17. The apparatus of claim 16 wherein said moving photosensitive medium is a rotating photosensitive drum.

18. An apparatus of claim 16 wherein said scanning mirror is pivotally supported by a first pair of torsional hinges.

19. An apparatus for generating a modulating scanning beam for producing an image comprising:

a photosensitive medium;

a single frequency scanning mirror for intercepting a light beam and redirecting said light beam toward said photosensitive medium;

drive circuitry for oscillating said scanning mirror at said single frequency to sweep said redirected light beam across said moving photosensitive medium;

circuitry for generating a multiplicity of image lines which combine to form a selected image on said photosensitive medium, each of said multiplicity of image lines comprised of a selected number of addressable image pixels per a selected unit of measurement;

apparatus for moving said photosensitive medium at a selected speed and in a direction orthogonal to said light beam sweeping across said photosensitive medium; and circuitry for generating said image lines at a selected rate determined as a function of said selected speed of said orthogonal movement so as to produce an image on said photosensitive medium with selected proportions.

* * * * *